US011105601B2

(12) United States Patent
Yen et al.

(10) Patent No.: US 11,105,601 B2
(45) Date of Patent: Aug. 31, 2021

(54) EXPLOSIVE THREAT MITIGATION UNIT

(71) Applicant: The Government of the United States of America, as represented by the Secretary of Homeland Security, Washington, DC (US)

(72) Inventors: Chian-Fong Yen, Lansdale, PA (US); Ashiq A. Quabili, Havre De Grace, MD (US); Chih-Tsai Chen, Moorestown, NJ (US); Nelson Carey, Cape May, NJ (US); Robert P. Kaste, North East, MD (US); Patrick O'Connor, Galloway Township, NJ (US); Jian H. Yu, Belcamp, MD (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 0 days.

(21) Appl. No.: 16/801,381

(22) Filed: Feb. 26, 2020

(65) Prior Publication Data

US 2020/0393231 A1 Dec. 17, 2020

Related U.S. Application Data

(60) Provisional application No. 62/861,068, filed on Jun. 13, 2019.

(51) Int. Cl.

| | |
|---|---|
| ***F42D 5/045*** | (2006.01) |
| ***B65D 21/02*** | (2006.01) |
| *F41H 5/04* | (2006.01) |

(52) U.S. Cl.

CPC ..... *F42D 5/045* (2013.01); *B65D 21/0233* (2013.01); *F41H 5/04* (2013.01); *F41H 5/0471* (2013.01)

(58) Field of Classification Search

CPC ..... F42D 5/045; F42D 5/04; F42B 39/14

(Continued)

(56) References Cited

U.S. PATENT DOCUMENTS 5,216,965 A * 6/1993 Liptak ..... F42B 39/20 109/27
5,668,342 A * 9/1997 Discher ..... F42B 33/06 102/293

(Continued)

OTHER PUBLICATIONS

LS-DYNA, Livermore Software Technology Corporation (LSTC), 7374 Las Positas Road, Livermore, CA 94551, pp. 1-6, https:www.lstc.com/products/ls-dyna, retrieved Feb. 7, 2020.

Yen, Chian-Fong, (2012), "A Ballistic Material Model for Continuous-Fiber Reinforced Composites," International Journal of Impact Engineering, 46, pp. 11-22, (2012).

http://www.dsm.com/products/dyneema/en_GB/about/downloads.category.Productsheets.html, retrieved Feb. 6, 2020.

(Continued)

*Primary Examiner* — Reginald S Tillman, Jr.

(74) *Attorney, Agent, or Firm* — Lavanya Ratnam; Kelly G. Hyndman; Robert W. Busby

(57) ABSTRACT

An explosive threat mitigation unit (TMU) stands ready to receive a suspected bomb, enclose it, and contain the explosion if one occurs. An operator protects bystanders and surroundings by putting the suspected bomb in a TMU and then closing the TMU. If the bomb goes off, the TMU mitigates the effects of both the blast and the fragments. One variation has a container, a tube, a cap, and a door. The container includes an opening. The tube, arranged in the container, aligns with the opening. The cap slides through the opening and over the tube. The door slides into place to close the opening and enclose the cap within the container.

19 Claims, 8 Drawing Sheets

(58) Field of Classification Search
USPC ..... 588/403; 86/50; 102/303
See application file for complete search history.

(56) References Cited

U.S. PATENT DOCUMENTS

| | | | | |
|---|---|---|---|---|
| 6,988,781 | B2 * | 1/2006 | Dang | B65D 88/14 312/409 |
| 6,991,124 | B1 * | 1/2006 | Palley | B65D 88/14 220/1.5 |
| 7,358,733 | B2 * | 4/2008 | Clark | G01V 5/0008 324/318 |
| 7,373,867 | B2 * | 5/2008 | Ryan | F41H 13/0043 588/403 |
| 8,291,657 | B2 * | 10/2012 | White | E06B 5/12 52/208 |
| 2006/0076350 | A1 * | 4/2006 | Weerth | B65D 88/14 220/88.1 |
| 2018/0356195 | A1 * | 12/2018 | McNelis | F42B 39/14 |

OTHER PUBLICATIONS

Detail Specification, "Laminate: Aramid-Fabric-Reinforced, Plastic", http://everyspec.com/MIL-SPECS/MIL-SPECS-MIL-DTL/download.php?spec=MILDTL-62474F.033577, pp. 1-13, MIL-DTL-62474F, Nov. 29, 2007.

Twaron, Filament Yarn, Teijin Aramid, http://www.teijinaramid.com/aramids/twaron/twaron-yellow-filament-yarn, retrieved Feb. 6, 2020.

Zhou, Y., Pervin, F., Biswas, M., Rangari V., Jeelani, S., "Fabrication and characterization of montmorillonite clay-filled SC-15 epoxy", Materials Letters, 60, (2006) pp. 869-873, Nov. 2, 2005.

List of Published Papers based on Applied Poleramaic, Inc. Products, http://www.appliedpoleramic.com/, retrieved Feb. 6, 2020.

"Kevlar Aramid Fiber Technical Guide", Dupont; https://www.google.com/url?sa=t&rct=j&q=&esrc=s&source=web&cd=1&ved=0ahUKEwxwcrl2bvMAhXL5SYKHV0VC2gQFggdMAA&url=http%3A%2F%2Fwww.dupont.com%2Fcontent%2Fdam%2Fdupont%2Fproducts-and-services%2Ffabrics-fibers-andnonwovens%2Ffibers%2Fdocuments%2FDSP_Kevlar%2520XPH170_datasheet_K23900, retrieved Feb. 6, 2020.

* cited by examiner

EXPLOSIVE THREAT MITIGATION UNIT

CROSS-REFERENCE TO RELATED APPLICATIONS

This application claims the benefit of priority from U.S. provisional application 62/861,068 filed on Jun. 13, 2019, the disclosure of which is incorporated by reference in its entirety.

STATEMENT OF GOVERNMENT INTEREST

The present invention was made by one or more employees of the United States Department of Homeland Security in the performance of official duties, and, thus the claimed invention may be manufactured, used, licensed by or for the United States without the payment of any royalties thereon.

FIELD

The field of this discussion is units that mitigate the threat posed by an explosive device.

BACKGROUND

Safety personnel put items that might explode in steel boxes, also referred to as containment vessels, to contain the possible explosion. The boxes are heavy and bulky. Even empty, their weight impedes rapid deployment. Their bulk prevents one-man porting and consumes too much space at already-cramped checkpoints. Their weight and size synergize, negatively, to make them unwelcome on airplanes and other conveyances.

The discussion below variously refers to items that might explode as bombs, improvised explosive devices (IEDs), threat items, suspected bombs, suspected IEDs, suspected threat items, suspect items, and the like.

SUMMARY

This document teaches, by example, ways to make containment vessels that are lighter, less bulky, or both. The discussion applies the term threat mitigation units (TMUs) to such vessels, referring to them also simply as devices.

BRIEF DESCRIPTION OF THE DRAWINGS

The attached drawings help explain the embodiments described below.

DETAILED DESCRIPTION

This description, like the drawings, omits some details to focus attention on key points. This detailed description teaches the invention by way of examples (embodiments) of TMUs. To find the outer limits of this invention, however, consult the appended claims instead of these examples.

Overview

A TMU stands ready to receive a suspected bomb, enclose it, and contain the explosion if one occurs. A human operator at a checkpoint, for example, protects bystanders and surroundings by putting the suspected bomb in a TMU and then closing the TMU. If the bomb goes off, the TMU mitigates the effects of both the blast and the fragments.

Experimental embodiments achieved the following: the use of advanced composite materials; a tare weight of under 120 lbs., including a storage case; a cost of less than $30,000; one-man portability; two-man liftability; a cube design of nineteen inches; a one-minute closing operation; and X-ray transmissibility. The X-ray transmissibility enables safety personnel to scan the interior of the TMU without opening the TMU. In one example implementation, an X-ray scan obtains detection information sufficient to automatically detect whether the suspected bomb triggers a scan alarm.

As discussed below and demonstrated in the experimental embodiments, compared to steel boxes, TMUs provide protection in a smaller space. They are lighter, less bulky, smaller, more portable, and less expensive to produce. Even so, not every example embodiment achieves every advantage, and a TMU can still be in accord with the invention without any advantage at all.

Example Embodiment

Figure 1:
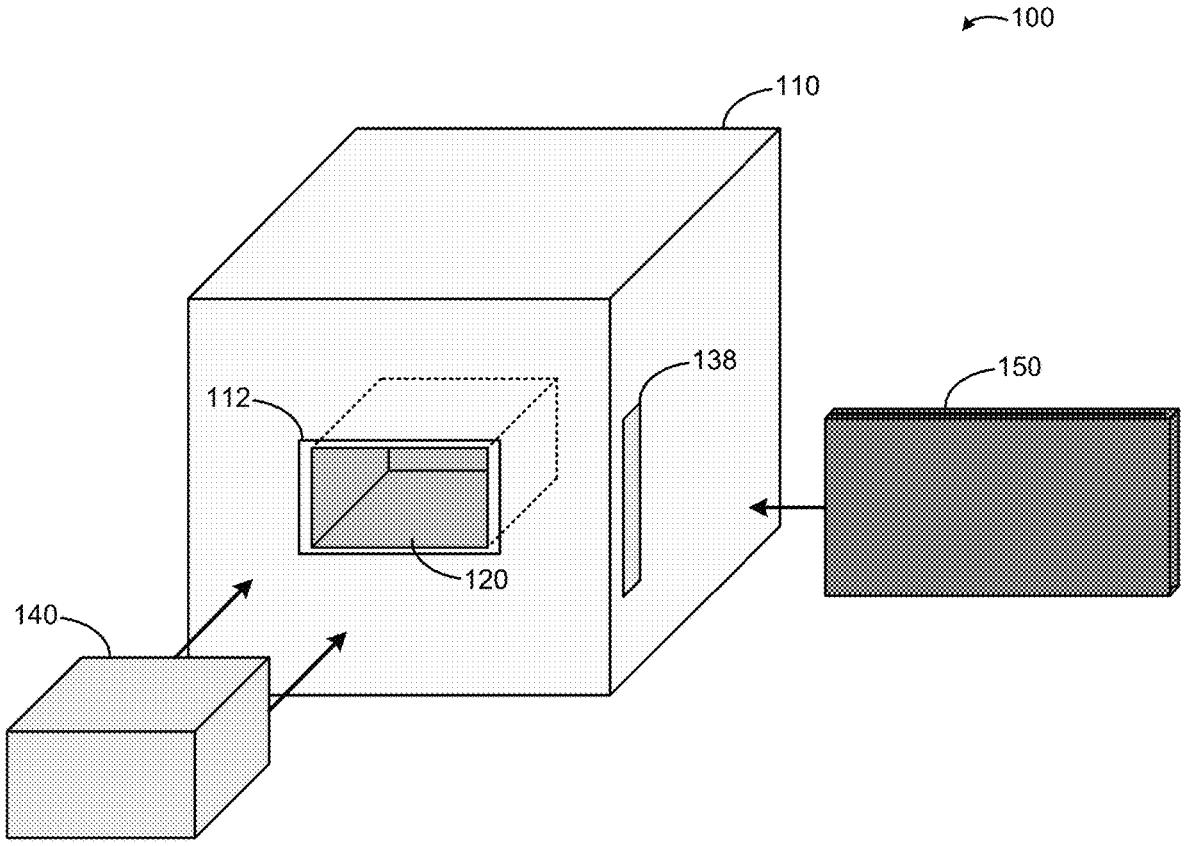
FIG. 1 illustrates a perspective view of a device or unit including a container and a door according to an example embodiment.

FIG. 1 illustrates a perspective view of a TMU device 100. Device 100 includes a container 110 and a door 150, according to an example embodiment. The container 110 has an opening 112. A tube 120, within the container 110, aligns with the opening 112. A cap 140 slides over and around the tube 120 when pushed through the opening 112. The container 110 also has a door slot 138. A door 150 slides through the door slot 138 and closes the opening 112. In a closed position, the door 150 encloses the cap 140 inside the container 110. The cap 140 and the interior tube 120 serve as the surroundings for a threat item.

In one embodiment, the opening 112 is 9×4 inches, and the tube 120 has a depth of 11 inches.

In an embodiment, an external, wheeled TMU storage case with a handle and a hinged upper lid holds the TMU. In this embodiment, the TMU is stored in the case with the TMU's door opening 112 facing upward, rather than the front-facing orientation illustrated in FIG. 1.

When the bomb detonates inside TMU 100, the detonation propels fragments outward at a speed greater than that of the blast shockwave. The surroundings (i.e., the combination of the tube 120 and the cap 140) are designed with a focus on defeating the threat from these fragments. The container 110 and door 150 are designed with a focus on handling the blast shockwave as it propagates and expands outward.

An alternative embodiment replaces cap 140 with a drawer and sleeve that are fitted together and then inserted into the tube 120. In this embodiment, the drawer fits inside the sleeve, and the sleeve fits inside the tube 120.

The tube 120 and the cap 140 as shown in FIG. 1, and the drawer and sleeve inserted into the tube 120 as described in the just-mentioned alternative embodiment, are two examples of the surroundings of the bomb. These examples of surroundings, as explained above, focus on defeating the fragmentation threat, and may be thought of more generally as a mechanism to mitigate fragmentation effects.

In another alternative embodiment, an outer sleeve (not shown) fits around the container 110. In one example, the outer sleeve has four sides that cover and surround at least four sides of the container 110. In another example, the outer sleeve has five sides that cover the top and four walls of the container 110. The container 110, the door 150, and the outer sleeves just mentioned all focus on defeating the blast threat, and may be thought of more generally as a mechanism to mitigate blast effects.

Experimental Design Process

The inventors iteratively modeled, simulated, and live-fire tested designs of the TMU. The discussion immediately below describes their approach.

A combined experimental and computational approach with subscale and full-scale prototype modeling and simulation, coupled with live explosive testing, was used in the design and development of the TMU device 100 to ensure desired mitigation performance in view of threat items expected to be encountered. Analysis efforts included material modeling, blast loading prediction, and dynamic ballistic/blast simulation according to a commercial code (such as LS-DYNA®). Various metals, composites, and hybrid materials for construction were considered. Design simulations, fabrications, and testing of subscale and full-scale prototypes were conducted. For example, features and materials of the device 100 were identified and refined based on a robust finite element analysis procedure utilizing a coupled Lagrangian-Eulerian approach, to model the fluid and structure interactions due to blast loading of a close-in explosive exerted on the structure surfaces. In the analysis procedure, various mesh sizes were used, including a mesh element size of 2 mm. The simulations were used to predict the pressure-time history of a confined internal reflective blast overpressure within example/prototype TMU devices, and the resulting dynamic structural responses subjected to various near-field blast tests.

In an example, the finite element analysis (FEA) software, LS-DYNA®, was used to model the blast threats and the components of the TMU being designed to contain them. The Arbitrary Lagrangian-Eulerian (ALE) solver was employed to simulate the blast and the dynamic deformation and damage of the TMU units. A user-defined material subroutine was used to input material properties for the various polymeric composite materials used in the TMU device designs.

The nature of simulations for the TMU devices changed as the program advanced. Initially, simulations were performed to characterize the nature of the threat and to determine the blast overpressure at a distance from the charge, to meet the goal of the device 100 being capable of capturing any and all fragmentation generated by the threat item, and to limit blast overpressure to less than 0.75 psi at 48 inches from the threat item. Influences of the threat item charge shape and its placement into fragmentation sources of nonsymmetrical behaviors were also studied. The simulation models to determine the blast overpressure and directional nature of possible configurations are large and detailed, requiring significant computational times. These models would run for three weeks to determine the movement of fragments and the pressure out to 48 inches in all directions from the threat item charge.

The threat item to be stored and contained was modeled as shell elements, with aluminum and printed circuit board (PCB) plastic laminate as the cover plate and the front screen, respectively. Properties of the explosive PRIMASHEET®2000 were used. An embodiment of the TMU device 100 is capable of mitigating 1.1 W weight unit of explosive threat for multiple explosive types and configurations. A baseline model simulated the device 100 and the explosive after detonation, and the resulting threat posed by fragments. In live testing, such high-speed flying fragments, some in the 3 km/s realm, were able to penetrate a 10 mm aluminum (Al2139-T8) plate at a standoff distance of one foot, which would be a lethal threat to a human. Design of the device 100 incorporated fragmentation control, such as an inner drawer/sleeve (e.g., serving as the illustrated tube 120 and cap 140 within the container 110) constructed of Kevlar and Dyneema® HB80 with supplementary layers of these materials to identify sufficient material to mitigate fragmentation with minimum weight.

Modeling and testing also helped determine characteristics for the outer containment of the TMU device 100, shown as container 110 in FIG. 1. The container 110 also provides fragment control and blast pressure mitigation to meet system requirements, while still providing fast and easy operation to place the explosive threat item into containment within the TMU device 100, via the sliding door 150 in addition to the inner storage area within the device 100.

Further simulations were performed to examine the pressurization of the blast containment, and to determine the ability for the device 100 to contain the blast overpressure without failing as a result of generating excessive pressure release. Analysis of the containment of pressure allowed for use of a finer mesh density in the simulation software for analyzing the containment components, while keeping computation times suitably short. Simulations were also modified to remove the fragmentation aspect of the threat, while focusing the simulation to examine the blast loading of the structures, to shorten simulation run times considerably (such simulations could be run in approximately a week).

Such simulations explored various different designs, including the illustrated cap and tube system including cap 140 and tube 120. The simulations identified that a more cubic shape of the device 100 would help to evenly distribute loading forces, while saving weight compared to designs that were less cubic and needed more reinforcement compared to the cubic designs. The cubic shape enabled extra space for the application of wraps around the door opening 112. Additionally, simulations analyzed performance of a cover gasket (see gasket 370 in FIG. 3A) as increasing sealing against gas flow through the interfaces of the internal components, the door 150, and the door interface at the opening 112, along with improved performance by variations in the implementation of reinforcement wraps (see wraps 362, 364, 366 in FIGS. 3F-3H), e.g., variations in the number, orientation, and positioning of the wraps. Such analysis and experimentation enabled the device 100 to reduce dynamic deflection (e.g. at the top and bottom of the unit), provide further rigidity near the corners, and to mitigate gas leakage. The types of materials used was also varied, such as changing the wraps from Kevlar K-29 to K-49 for increased strength and stiffness. Simulations showed that the addition of another wrap was beneficial in constraining container wall deflections and more evenly distributing the stresses to the TMU device 100.

The simulation again added finer meshes to increase through-thickness modeling of the many layers in the containment structure, and to allow for different orientations in placement of the explosive threat item contained within the tube 120. Controlling placement and orientation of the explosive threat item within the containment structure is easily controlled to enhance the mitigation performance of the TMU device 100, e.g., via item stabilizers 921 as shown in FIG. 9A, discussed further below.

Simulations were also used to consider various combinations of container and subcontainer thicknesses, shapes, and nesting orders. The effects of a five-sided (closed-ended) tube 120 on controlling the pressurization of the containers was determined, in comparison to an open-ended four-sided drawer/sleeve design approach that was also analyzed. The effects of a closed five-sided outer subcontainer were compared with an outer container four-sided sleeve embodiment. The assemblage of the three subcontainers was rearranged to provide higher rigidity near the front side and the corners of the unit. The flow of gas within and around the containers, door, tube, cap and cover gasket was also analyzed and the simulation analysis results were used to further iterate and influence the designs of these components, e.g., based on dynamic deformation and stress of the containers and the effect of reinforcement wrap variations.

The simulated/computed results were validated through comparison with physical testing that produced actual experimental data, confirming various results. For example, the first level of containment (e.g., provided by the specially designed tube 120 and cap 140) drastically reduces the blast over-pressure, and even further blast mitigation is provided by additional mitigation mechanisms (e.g., container 110, door 150, wraps, etc.). Analysis of the physical expansions experienced by the drawer and sleeves was used as input in the design of the next layer of mitigation/confinement, providing multiple layers of mitigation technologies, while meeting size and weight specifications for the overall design of the TMU device 100, as well as other performance criteria.

Additional enhancements achieved based in part on the testing and design iterations includes the redistributing and/or adding of individual outside wraps (see FIG. 2B) to increase bending rigidity around the door opening 112, and reinforcing container edges by weaving vertical and horizontal wraps around the edges of the container 110, such as a weaving layup between vertical and horizontal wraps and adding more layer(s) a given wrap (e.g., increasing a thickness of a wrap from 0.25 inches to 0.3 inches). In an embodiment, one or more wraps are configured to serve as sacrificial mechanisms, e.g., to break in the act of preserving the structural integrity of the TMU container 110.

Deformation of the TMU device 100 is minimal and provides a mitigation mechanism. Testing showed a maximum observed TMU body panel deformation of 4.13 inches, occurring at 2.25 ms (+/−35.7 μs) on a side of the container 110. The measured first peak pressures at 48 inches from the TMU were all lower than 0.75 psi, and substantially all of the measured highest peak pressures at 48 inches were lower than 1.0 psi. The initial deformation of a side occurred at 178.6 μs (+/−35.7 μs) after detonation, having a magnitude of 0.057 inches located roughly 10 inches below the top and 6 inches aft of the TMU device's front. At one ms (+/−35.7 μs) after detonation, the largest deformation was 3.38 inches. The maximum deformation occurred at 2.25 ms (+/−35.7 μs) with magnitude of 4.13 inches, located roughly at the center of the side panel. On the back side, the initial deformation of 0.0071 inches occurred at 300 μs (+/−25 μs) after detonation, located roughly at 15 inches below the top and 7 inches away from a side of the container 110. At one ms (+/−25 μs) after detonation, the largest deformation was 0.7 inches. The maximum deformation occurred at 7.3 ms (+/−25 μs) with magnitude of 3.58 inches located approximately at midway between the left and right side and 3 inches below the top.

The TMU in an embodiment provides mitigation of an explosive charge of 1.0 W/H2 with full containment of fragments, and provide blast mitigation by limiting blast pressures, measured at a distance of four feet, to less than 0.75 psi. In an embodiment that includes an external storage case, the blast pressure, measured at a distance of four feet, was less than 0.23 psi.

Further Embodiments

Figure 2A:
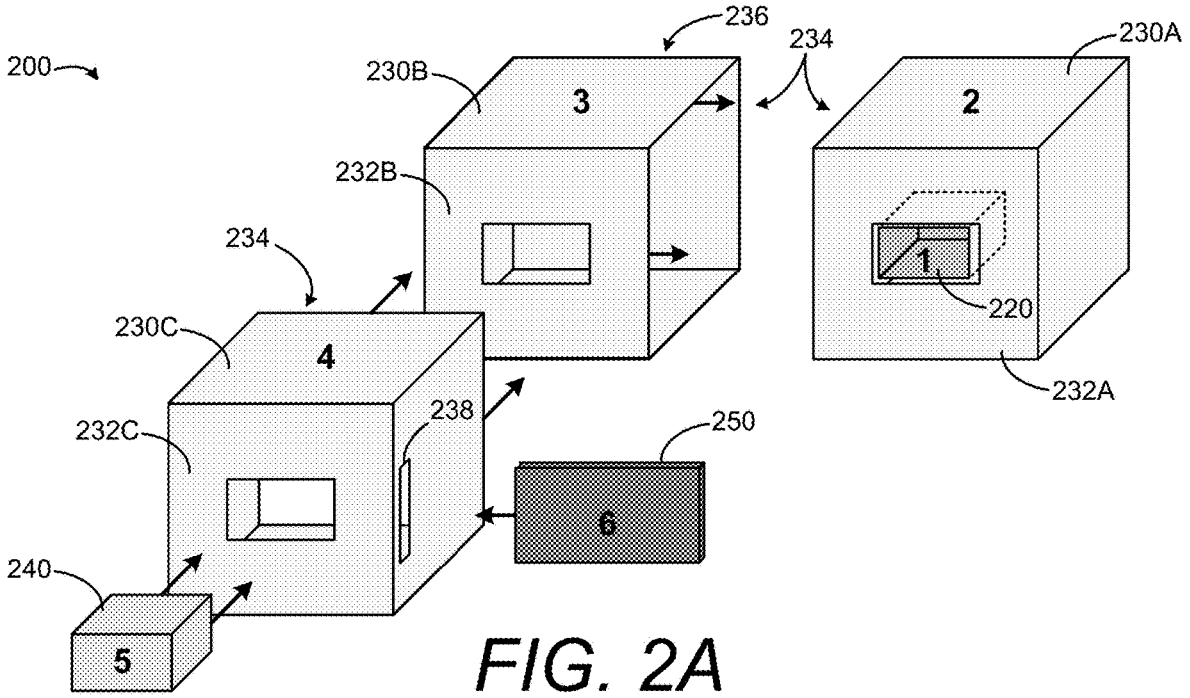
FIG. 2A illustrates a perspective view of a device including a plurality of subcontainers and a door according to an example embodiment.

FIG. 2A illustrates a perspective view of a device 200 including a plurality of subcontainers 230A, 230B, 230C and a door 250 according to an example embodiment. The subcontainers 230A, 230B, 230C each include an opening to allow access to the tube 220, which is coupled to subcontainer 230A. The subcontainers 230A, 230B, 230C are nested together to align the openings for insertion of the cap 240, with the outermost subcontainer 230C including a door slot 238 to allow insertion of the door 250 over the cap 240.

Each of the given subcontainers 230A, 230B, 230C includes five closed walls 236 and an open side 234, which are used in assembly of the various components. First, the tube 220 (and gasket, not shown in FIG. 2A) is inserted through the open side 234 of subcontainer 230A (see FIG. 3B). Second, subcontainer 230A and the tube 220 (and gasket) are secured to each other in preparation of being nested within subcontainer 230B. Third, the subcontainer 230B is placed over subcontainer 230A, by moving the open side 234 of subcontainer 230B toward the open side 234 of subcontainer 230A, so that subcontainer 230B slides over subcontainer 230A to cause subcontainer 230A to be nested inside of subcontainer 230B with the respective sub-opening walls 232B and 232A aligned. Fourth, the subcontainer 230C is placed over the nested combination of subcontainers 230A, 230B, to cause subcontainers 230A, 230B to be nested inside of subcontainer 230C with sub-opening wall 232C aligned with sub-opening walls 232B, 232A. Fifth, the cap 240 is inserted through the aligned openings, such that the open side of the cap 240 engages with the open side of the tube 220. Sixth, the door 250 is inserted through the door slot 238, allowing the door to straddle a portion of the sub-opening wall 232B of subcontainer 230B (which is exposed through the door slot 238 when the subcontainers 230A, 230B, 230C are nested).

The open sides 234 of the nested subcontainers 230A, 230B, 230C do not coincide, and face different directions when assembled together. The open side 234 of a subcontainer can serve as a potential weakness, so a closed wall 236 of a given subcontainer is used to cover the open side(s) 234 of the subcontainer(s) nested within, to serve as yet another mitigation mechanism of the device 200. The device 200 illustrates three subcontainers 230A, 230B, 230C. In other embodiments, fewer or more than 3 subcontainers are used, as appropriate for mitigation requirements associated with a given loading and strength scenario. Thus, FIG. 2A illustrates n=3 subcontainers nested to orient an open side of a given subcontainer toward n−1=2 closed walls of n−1=2 corresponding other subcontainers. Accordingly, in an embodiment, a mitigation requirement is given in terms of a minimum desired wall thickness, and n is chosen to meet that thickness value, in conjunction with the thickness of a given wall multiplied by (n−1) for the nested subcontainers.

Figure 2B:
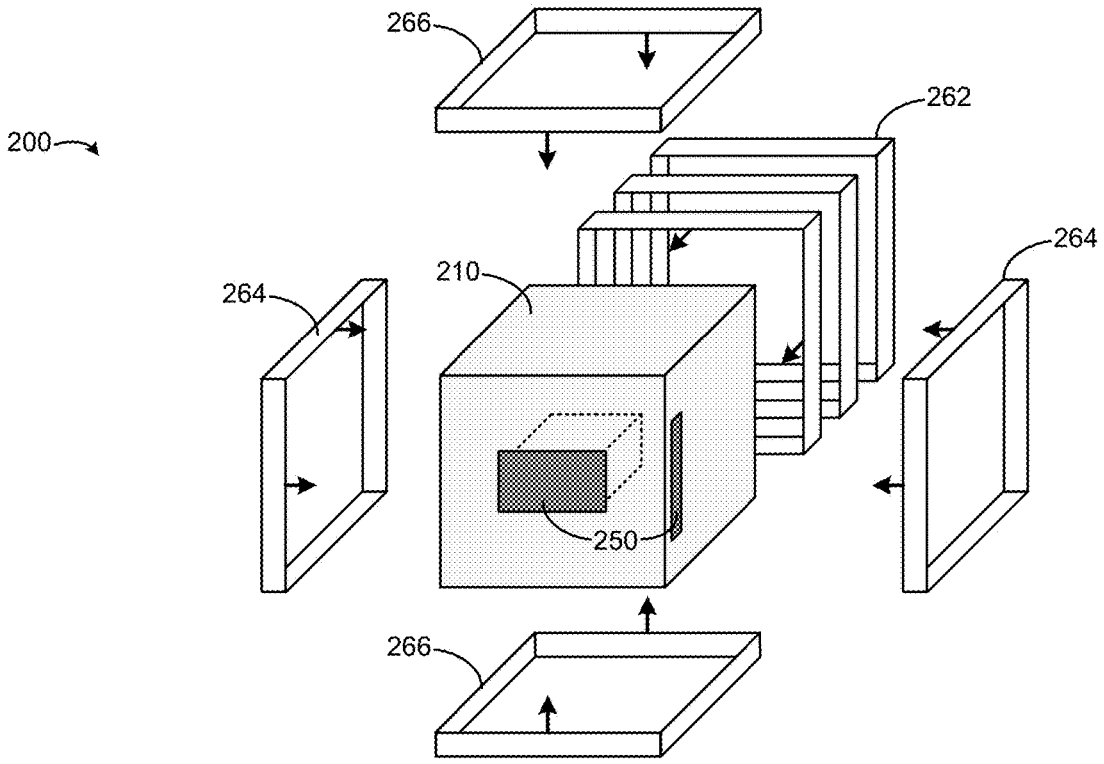
FIG. 2B illustrates a perspective view of the device including a plurality of wraps according to an example embodiment.

FIG. 2B illustrates a perspective view of the device 200 including a plurality of wraps 262, 264, 266 according to an example embodiment. The container 210 is formed by the nested subcontainers 230A, 230B, 230C with cap 240 (not visible in FIG. 2B) and door 250 inserted.

The wraps include side-to-side wraps 262 (SS wraps) aligned along a first plane, vertical front-to-back wraps 264 (VFB wraps) aligned along a second plane perpendicular to the first plane, and horizontal front-to-back wraps 266 (HFB wraps) aligned along a third plane perpendicular to the first and second planes. As illustrated, the wraps 262, 264, 266 are shown being slid over the container 210 as pre-formed loops. In other embodiments, one or more of the wraps 262, 264, 266 are applied by wrapping a strip around the container 210. Additionally, in other embodiments, one or more of the wraps 262, 264, 266 are intertwined, e.g., by applying the strips for that plurality of intertwined wraps together and passing the strips over/under each other to integrate the wraps with each other in the wrapping process.

Various materials are used to form the illustrated components, including HB80 Dyneema uni-tape, Kevlar®/phenolic prepreg fabric, Twaron Aramid fiber, SC-15 epoxy resin, Kevlar® XP H170, ultra-high molecular weight polyethylene (UHMWPE), and other materials as set forth in further detail below.

FIGS. 3A-3H illustrate perspective views of a device 300 including a plurality of elements according to an example embodiment. The TMU device 300 is constructed by fabricating and assembling components, which are made of composite materials. The components are assembled together, e.g., by nesting interior and exterior components, and then reinforcing them with fiber/epoxy resin wraps. These components include: interior cap 340, interior tube 320, interior cover gasket 370, subcontainer 330A, subcontainer 330B, subcontainer 330C, U-profile door 350, and composite wraps 362, 364, 366.

Figure 3A:
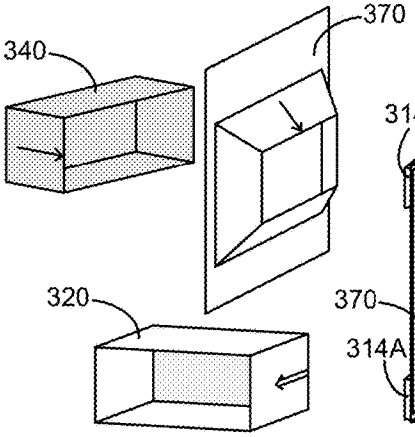
FIGS. 3A, 3B, 3C, 3D, 3E, 3F, 3G, and 3H illustrate perspective views of a device including a plurality of assembled elements according to an example embodiment.

FIG. 3A illustrates an example cap 340, tube 320, and gasket 370. The cap 340 is checked for proper fit, e.g., by inserting an open side of the cap 340 onto an open side of the interior tube 320, and also ensuring that the cap 340 fits through the opening in the gasket 370. The gasket 370 is configured to be fitted around the container opening 312, and to extend between the subcontainer 330A and the cap 340 interfaced with the tube 320.

The interior cap 340, interior tube 320, and interior cover gasket 370 are fabricated from HB80, a product of DSM Dyneema®. HB80 is a uni-tape reinforced with Ultra-High Molecular Weight Polyethylene (UHMWPE). The product typically comes in 63-inch wide roll with a sheet containing four single layers of unidirectional cross plied at 90 degrees to each other) (0°/90° and consolidated with a polyurethane (PUR) based matrix. Approximate density of this material is 0.97-0.98 g/cm$^3$.

The inner- and outer-most skins of the interior cap, interior tube, and interior gasket cover are fabricated from Kevlar® XP H170 in an embodiment. This material, used in the TMU interior components, provides some fire resistance and reduces the fraying of fiber materials during TMU operation. This product uses Kevlar KM2 plus fiber with high toughness thermoplastic resin matrix. This product has a broad range of processing capabilities in terms of curing temperature and pressure, and is suitable for co-molding with other fiber materials.

Figure 3B:
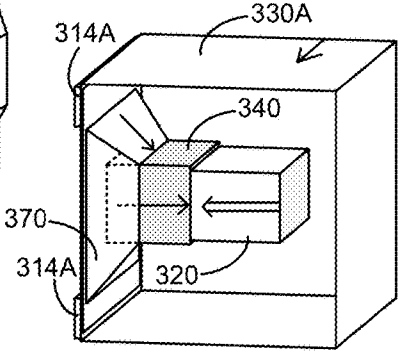

FIG. 3B illustrates the interior cap 340, tube 320, and cover gasket 370 assembled into subcontainer 330A. The gasket 370 is attached to an interior wall of the subcontainer 330A (to surround the opening 312 in the subcontainer 330A). The cap 340 and tube 320 are insertable through the opening 312 in the subcontainer 330A, and through the cutout passage of the gasket 370. As illustrated in FIG. 3B, the cap 340 and tube 320 are supported via a wall of the subcontainer 330A, where the tube 320 and cap 340 are stabilized by the wall and/or gasket 370. In other embodiments, the tube 320 (and/or cap 340 as slidably supported by the tube) is centered and stabilized inside the subcontainer 330A, e.g., via foam beams, or other stabilizers used to secure the interior tube 320 to interior wall(s) of the subcontainer 330A and maintain the position of the interior components within the container (for example, see tube stabilizers 511 in FIG. 5). The gasket 370 is bonded to the inside of subcontainer 330A. First spacers 314A, formed of foam sheets in an embodiment, are fit over the exterior of the subcontainer 330A and spaced apart vertically to form a channel to slidably receive the door 350. The cap 340 is not bonded, and is slidable for withdrawal/insertion, independent of the bonding of other components. The assembly of interior components into subcontainer 330 is completed, and further assembly of additional subcontainers can proceed, securing the interior components within the assembled nested subcontainers. For convenience, a single-line arrow indicator is drawn atop the subcontainer 330A, to assist the viewer in keeping track of the orientation of the subcontainer 330A in FIGS. 3B, 3C (arrow shown in dashed lines), and 3D (arrow shown in dashed lines). Similar arrows are used to keep track of the orientation of the subcontainer 330B (using a double-line arrow indicator) and 330C (using a triple-line arrow indicator).

The three subcontainers 330A, 330B, 330C and U-shaped door 350 are fabricated from Kevlar®/phenolic prepreg fabric in an embodiment. Kevlar K29 of nominally 3000 Denier yarns is used to form 17×17 plain weave, which is pre-impregnated with a PVB phenolic resin (12% to 18% resin content). The product is compliant with MIL spec MIL-DTL-62474F, Class D. The density of this pre-impregnated material is approximately 1.3 g/cm$^3$.

Figure 3C:
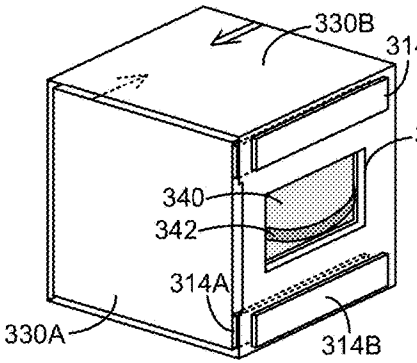

FIG. 3C illustrates subcontainer 330A with assembled interior components nested within subcontainer 330B, with the corresponding door openings 312 of each subcontainer aligned such that cap 340 is visible through an open passage faced by opening 312, exposing the cap handle 342 for easy handling/insertion/removal of the cap 340. The first spacers 314A shown in FIG. 3B establish a spacing gap between the front wall of subcontainer 330A and the front wall of subcontainer 330B, of approximately 0.5 inches (e.g., using foam strips of 0.5 inches thickness). Similarly, second spacers 314B are bonded to the exterior window wall of subcontainer 330B, creating a second channel within which the door is slidable (e.g., a first door panel fits in the channel formed by spacers 314A, and a second door panel fits in the channel formed by spacers 314B, with the first and second door panels sandwiching the front/window wall of the second subcontainer 330B). Thus, the spacers are disposed between adjacent subcontainers, to establish channels within which the door is slidable, while also spacing apart the walls of adjacent subcontainers 330A, 330B, and 330B, 330C. In other words, a given subcontainer includes a sub-opening wall that surrounds an opening in that subcontainer (and therefore forms a portion of the entire opening 312 formed by the nested subcontainers in forming the entire container 310). Spacers 314A form first spacing between first and second sub-opening walls of nested first and second subcontainers 330A, 330B. Spacers 314B form a second spacing between second and third sub-opening walls of nested second and third subcontainers 330B, 330C. The first and second spacings are configured to accommodate first and second door panels of the door 350. The spacers 314A, 314B prevent a given subcontainer from fully sliding into or over its adjacent nested subcontainer, holding apart adjacent subcontainers to provide space to allow the door 350 to slide.

Figure 3D:
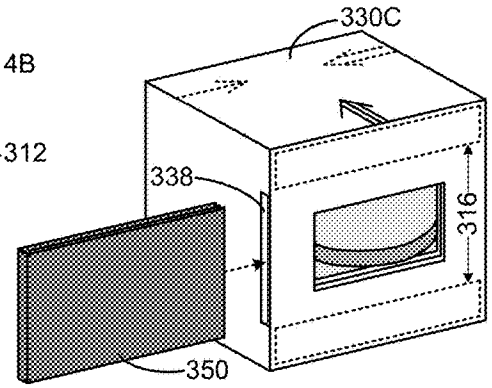

FIG. 3D illustrates the assembled subcontainers 330A, 330B nested into subcontainer 330C. An orientation of the subcontainers 330A, 330B is indicated via dashed arrows. The opening in subcontainer 330C is aligned with the openings in subcontainers 330A, 330B, to create the open passage for insertion/removal of the cap 340. The door channel 316 is labeled in FIG. 3D, formed by the second spacers 314B and the first spacers 314A.

The subcontainer 330C includes a door slot 338, for insertion of the door 350. The door 350 has a U-configuration including a first door panel, a second door panel spaced from the first door panel, and a side door panel connecting the first door panel to the second door panel. The door slot 338 formed in subcontainer 330C exposes an edge of a side of subcontainer 330B. Thus, the door is slidable between at least two subcontainers, based on the spacing and nesting of the subcontainers 330A, 330B, 330C presenting a pair of door channels, enabling the U-shaped door 350 to straddle a wall of the subcontainer 330B and allow a first panel of door 350 to enter the first channel between spacers 314A behind the subcontainer 330B, and a second panel of door 350 to enter the second channel between spacers 314B in front of the subcontainer 330B. The U-shaped cross-sectional profile of the door 350, coupled with the plurality of door channels, provides additional mitigation mechanisms to the device 300, enabling the door to robustly withstand blast and/or fragment effects.

Figure 3E:
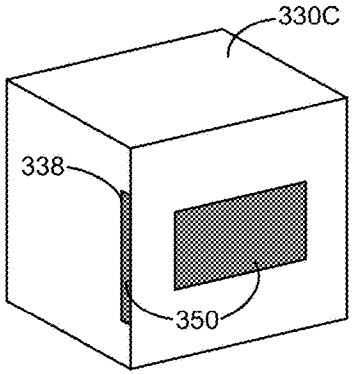

FIG. 3E illustrates the nested subcontainers with subcontainer 330C forming an exterior. The U-shaped door 350 is inserted through the door slot 338 located in subcontainer 330C, enabling verification of the sliding operation of the door 350. Additional machining/trimming can be applied to the various components, to ensure that the door 350 slides smoothly through the two channels created by the various subcontainers and spacers.

Figure 3F:
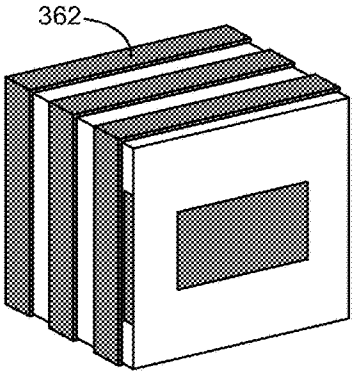

FIG. 3F illustrates the device wrapped with three side-to-side (SS) wraps 362. In other embodiments, a greater or fewer number of SS wraps 362 are used, according to desired mitigation effects and/or expected threats. In an embodiment (not shown) a single, wide band is used to cover an entirety of the side surfaces of the device for increased strength compared to spaced wraps. The spaced SS wraps 362 do not cover the entirety of the side surface as illustrated, and reduce materials needed to fabricate the SS wraps 362. The three SS wraps 362 cover edges and a middle of the TMU device, so the TMU withstands the extensions from the various surfaces, pushing out and stretching the SS wraps 362 and other wraps which mitigate and absorb energy from the explosion. The combination of various types of wraps covers corners and other surfaces of the device that undergo stress loading, from all directions.

A total of three uni-directional fiber wrap bands are applied to serve as the SS wraps 362 of the assembled TMU device 300. To apply the SS wraps 362, the door 350 is removed and replaced with two steel inserts (0.5 inches thick each) so that the door gap channels between the subcontainers do not collapse under vacuum pressure during a cure cycle. The window area of opening 312, and the door slot 338, are covered with masking tape to prevent resin from entering the TMU cavities. Each wrap band comes in a unidirectional dry fiber spool (25 yards, 4.75 inches width). From the wrap spools, about 770 g±5 g of fiber material is applied to the TMU device 300 per wrap using approximately ten revolutions of the wrap around the container. Mixed SC-15 epoxy resin (Part A, Part B) is placed onto a bucket. During each revolution, a paint brush is used to coat the fiber layers with resin, and extra resin is squeezed out using a metal roller. Once all three SS wraps 362 are coated, a vacuum bag is applied to the TMU assemblage and sealed. Approximately 7 psi of vacuum is applied and the TMU device is allowed to cure in room temperature for two hours. Then the TMU device is placed inside a conventional oven and heated at 120 degrees F. for two hours while 7 psi of vacuum is maintained. The TMU device is then cooled off, vacuum is released, and the part is debagged and ready for applying additional wraps. In alternate examples, the SS wraps 362 are intertwined with one or more of the other wraps 364, 366.

Figure 3G:
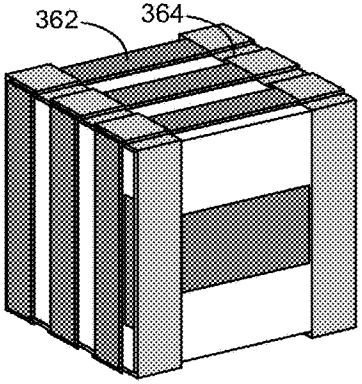
Figure 3H:
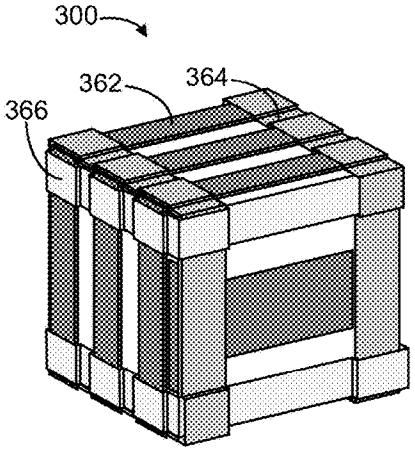

FIGS. 3G and 3H illustrate two vertical Front-to-Back (VFB) and two Horizontal Front-to-Back (HFB) wraps applied to the TMU device. For each VFB wrap 364, an approximate weight of 835 g±5 g fiber material is applied to the part using eleven revolutions. For each HFB wrap 366, an approximate weight of 770 g±5 g fiber material is applied to the part using ten revolutions.

At least a portion of the various wraps are intertwined over and under. As shown in FIG. 3H, the VFB wraps 364 and HFB wraps 366 are intertwined as indicated by the top left and bottom right front corners of the device 300 showing HFB wraps 366 outermost, with the top right and bottom left front corners of the device 300 showing VFB wraps 364 topmost. In other embodiments, all wraps 362, 364, 366 are intertwined, or none of the wraps are intertwined. The wraps are intertwined during the resin coating procedure. The intertwined wraps provide added structural stiffness and mitigation strength. The epoxy resin is applied and cured following the procedure described as set forth above with reference to FIG. 3F. Once cured, the device 300 is debagged. Excess materials (such as steel inserts, Teflon/masking tape, and resin residue) are removed. The device 300 is checked to see if additional machining is needed to ensure the smooth operation of the door 350 sliding and cap 340 insertion/removal.

The wraps 362, 364, and/or 366 are formed from Twaron Aramid fiber. The dry fiber yarns can be purchased from vendors in bundles/tows. The fiber tows are made of high-modulus (series 2200) filament yarns 3220 dTex (2900 Denier) aramid fiber which has Kevlar® K49 equivalent material properties with a density of 1.45 g/cm$^3$. The dry Twaron fiber yarns are acquired for producing a custom-shaped unidirectional fiber roll to facilitate TMU wrap construction. For this application, the unidirectional rolls are made with 3.75-inch width, and 17 ends/inch. A hot-melt coated polyester (e.g., 220 Denier) fiber material is used to bind the aramid fiber yarns as well as to keep the edges in place.

SC-15 epoxy resin, a thermosetting epoxy, is used to wet the dry Twaron Aramid fiber wraps. It is a low-viscosity two-phased toughened epoxy resin system consisting of Part A (resin mixture of diglycidylether epoxy toughener) and Part B (hardener mixture of cycloaliphaic amine poluoxyl-alkylamine). The density of the cured epoxy is roughly 1.13 g/cm$^3$.

Figure 4:
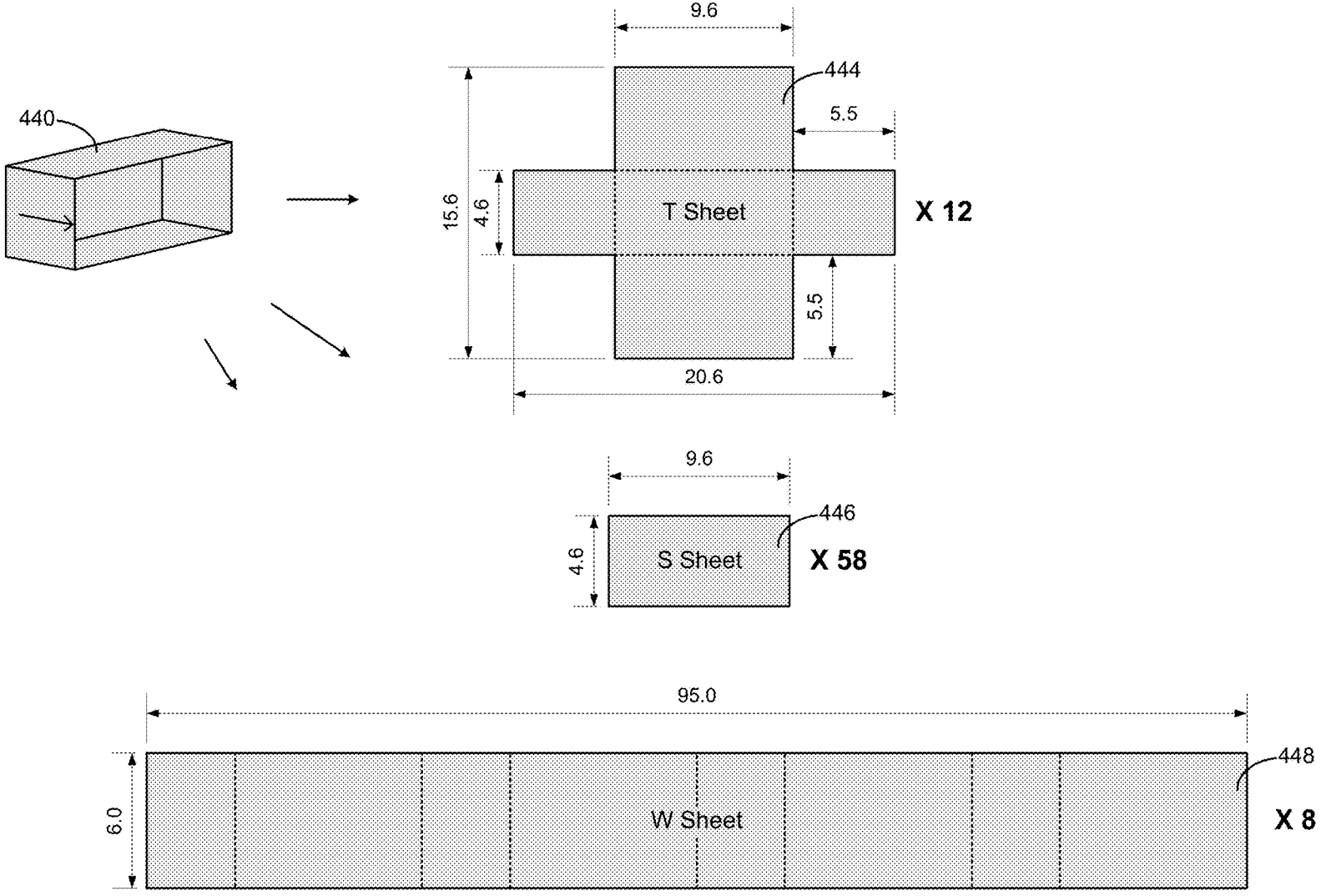
FIG. 4 illustrates a perspective view of a cap, in one example embodiment, and how the cap is constituted from various constituent sheets, according to an example embodiment.

FIG. 4 illustrates a perspective view of a cap 440 including a plurality of constituent sheets (T sheet 444, single sheet 446, wrap sheet 448) according to an example embodiment. Multiple copies of differently-shaped sheets (e.g., 444, 446, 448) are layered together. To improve mitigation strength and avoid weakness in seams, a first seam of a first sheet does not align with a second seam of a second sheet. In an embodiment, multiple sheets are layered together without any seams being aligned/overlapping, so the material of at least one sheet spans a given seam/edge between walls of the formed component (e.g., the cap 440 is illustrated, and similar layers are used for other similarly-shaped components as set forth below).

The cap 440 has five closed sides and one open side (similar to other components such as the tube and subcontainers, to which the following guidelines are also applicable, and apply in part to the parts such as the door and gasket which have other geometries). An embodiment of the cap 440 has goal interior dimensions (L×W×H) of 5.5 inches×9.6 inches×4.6 inches and exterior dimensions (L×W×H) of 6.0 inches×10.1 inches×0.5 inches. The cap 440 is formed of polyethylene material that is cut into layers with three distinct shapes: T sheets (T) 444, Wraps (W) 448, and Single (S) sheets 446. A total of 12 T, 8 W, and 58 S sheets are used to fabricate the cap 440. The goal thicknesses of the front wall and four side walls are 0.5 inches and 0.25 inches, respectively. A total of 70 layers (58 S, and 12 T sheets) are used to achieve 0.5 inches thick wall and 36 layers [12 T+8 W (×3 revolutions)] are used to achieve a 0.25 inches wall thickness. Below, Table 1 summarizes the layup sequence for fabrication of the cap.

TABLE 1

| Sequence | Sides (4) | Front (1) |
|---|---|---|
| 1 | 3 T, 2 W | 15 S |
| 2 | 3 T, 2 W | 15 S |
| 3 | 3 T, 2 W | 15 S |
| 4 | 2 T, 2 W | 13 S |
| 5 | 1 T | |
| Total # Plies | (8 W × 3 rev) + 12 T = 36 | 58 S + 12 T = 70 |

Note that the illustrated example dimensions provided for the T and S sheets are for the first cuts. Subsequent plies for T and S geometries are cut incrementally at 1.015 scale. This scale is maintained throughout the fabrications of other components that also have S- and T-shaped sheets, and the scaling of the sheets contributes to the ability to avoid overlapping seams. Such components, including subcontainers, the tube, and the cap, are formed with differently shaped sheets layered together such that the seams do not align with each other. The cap 440 is shown in some embodiments (FIGS. 3C, 3D, 9A, 9B) with a handle 342, 942, which is formed as a fiberglass strap. In fabrication, the handle is placed into the stacked layers (prior to curing) by making a small incision.

For fabrication of the cap 440, tube 320 (see FIG. 3B) and gasket 370, additional layers of Kevlar® XP H170 are used for the interior and exterior skins. A total of two T-shaped XP H170 layers are cut, one of which is placed as the top layer and the other is placed as the bottom layer of the stacked HB80 plies. The preform is then sealed with bagging material and run through the cure cycle.

The tube 320 has five closed sides and one open side. An embodiment of the tube 320 has goal interior dimensions (L×W×H) of 11 inches×9 inches×4 inches and exterior dimensions (L×W×H) of 11.25 inches×9.5 inches×4.5 inches. Each wall thickness is desired to be 0.25 inches. The polyethylene HB80 material is cut to layers in three different shapes to produce T, W, and S sheets. A total of 17 T, 6 W, and 24 S sheets are used to fabricate this item. The goal thicknesses of 0.25 inches per wall is achieved by stacking up a total of 35 plies. Table 2 below summarizes the layup sequence for fabrication of the interior tube. Similar to the cap (and other components), in an embodiment, subsequent plies in the tube 320 are incrementally scaled up, e.g., to avoid overlapping seams between the plurality of plies.

TABLE 2

| Sequence | Sides (4) | Back (1) |
|---|---|---|
| 1 | 4 T, 2 W | 6 S |
| 2 | 4 T, 2 W | 6 S |
| 3 | 4 T, 2 W | 6 S |
| 4 | 5 T | |
| Total # Plies | (6 W × 3 rev) + 17 T = 35 | 18 S + 17 T = 35 |

An embodiment of the gasket 370 has an overall length and width of 15.9 inches×16.9 inches. The gasket 370 is constructed by laying up ten plies of HB80. An embodiment of the gasket 370 has a goal wall thickness of approximately 0.10 inches. The purpose of this component is to reduce the gas leakage through the cavity window/door locations. The gasket 370 has a flat surface that is secured to the inside wall of the first subcontainer 330A. The gasket 370 has four additional walls that create a concave shape with a clearance for the cap 340 to be inserted and withdrawn. This component is fabricated by using a concave (male) shaped mold. The mold dimensions are approximately 14.7 inches×9.7 inches outer dimensions, with walls at 45-degree angles for a depth of 2.0 inches toward interior dimensions of 10.7 inches×5.7 inches. A total of ten rectangular shaped HB80 plies (18 inches×16 inches) are cut and draped on to the mold by folding the plies at four corners to conform to the mold. The plies are not cut at the corners to avoid weakening of the material. A ply of Kevlar X170 is added to the top and another ply is added to the bottom of the stacked HB80 plies as cover sheets. After the part is cured, the component is trimmed to the goal length and width dimensions. A cavity (window) is cut out to accommodate insertion and retreat of the cap 340.

The first subcontainer 330A has five closed sides and one open side. The material used for fabricating this component is Kevlar 745 prepreg. An embodiment of the first subcontainer 330A has goal interior dimensions (L×W×H) of 16.0 inches×16.8 inches×16.0 inches and exterior dimensions (L×W×H) of 16.5 inches×17.1 inches×16.5 inches. The expected wall thickness per side is approximately 0.23 inches. In an embodiment, the mold for fabricating the container components is oversized in the width dimension to ease the removal of the cured parts from the mold. After removal of the cured part, the part is cut to the final dimensions. The Kevlar prepreg material is cut into layers of three shapes to create T, W, and S sheets. A total of 6 T, 3 W and 6 S sheets are used to fabricate this item. The estimated cured-ply thickness for this material is 0.019 inches. The goal thicknesses of 0.23 inches per wall is achieved by stacking up a total of 12 plies per wall. Table 3 below summarizes the layup sequence for fabrication. The W sheets are cut oversized approximately at 150 inches×18 inches. During the layup, each W is wrapped for two revolutions, and the leftover material is trimmed off after stacking is complete. The wrap seams are arranged so they do not align with each other during the layup, to avoid inducing any weak spots.

TABLE 3

| Sequence | Sides (4) | Back (1) |
|---|---|---|
| 1 | 2 T, 1 W | 2 S |
| 2 | 2 T, 1 W | 2 S |
| 3 | 1 T, 1 W | 2 S |
| 4 | 1 T | |
| Total # Plies | (3 W × 2 rev) + 6 T = 12 | 6 S + 6 T = 12 |

The second subcontainer 330B has five closed sides and one open side. The material used for fabricating this component is Kevlar 745 prepreg. An embodiment of the second subcontainer 330B has goal interior dimensions (L×W×H) of 17.0 inches×17.1 inches×16.6 inches and exterior dimensions (L×W×H) of 17.5 inches×17.4 inches×17.1 inches. The expected wall thickness per side is approximately 0.25 inches. After removal of the cured part, the width is cut to the final dimensions. The Kevlar prepreg material is cut to layers in 3 different shapes as T, W, and S sheets. A total of 7 T, 3 W and 6 S sheets are used to fabricate this item. The goal thicknesses of 0.25 inches per wall is achieved by stacking up a total of 13 plies per wall. Table 4 below summarizes the layup sequence for fabrication. The W is cut oversized (e.g., 150 inches×17.5 inches) and the leftover material is trimmed off after stacking is complete. As described above, the wrap seams are not aligned with each other during the layup procedure.

TABLE 4

| Sequence | Sides (4) | Back (1) |
|---|---|---|
| 1 | 2 T, 1 W | 2 S |
| 2 | 2 T, 1 W | 2 S |
| 3 | 2 T, 1 W | 2 S |
| 4 | 1 T | |
| Total # Plies | (3 W × 2 rev) + 7 T = 13 | 6 S + 7 T = 13 |

The third subcontainer 330C has five closed sides and one open side. The material used for fabricating this component is Kevlar 745 prepreg. An embodiment of the third subcontainer 330C has goal interior dimensions (L×W×H) of 17.9 inches×17.8 inches×17.5 inches and exterior dimensions (L×W×H) of 18.2 inches×18.1 inches×17.75 inches. The expected wall thickness per side is approximately 0.25 inches. The Kevlar prepreg material is cut to layers in 3 different shapes as T, W, and S sheets. Similar to second subcontainer 330B, a total of 7 T, 3 W and 6 S sheets are used to fabricate this item. The goal thicknesses of 0.25 inches per wall is achieved by stacking up a total of 13 plies per side. Table 5 below summarizes the layup sequence for fabrication. The fabrication steps for the third subcontainer 330C are similar to the procedures for the first and second subcontainers 330A, 330B.

TABLE 5

| Sequence | Sides (4) | Back (1) |
|---|---|---|
| 1 | 2 T, 1 W | 2 S |
| 2 | 2 T, 1 W | 2 S |

TABLE 5-continued

| Sequence | Sides (4) | Back (1) |
|---|---|---|
| 3 | 2 T, 1 W | 2 S |
| 4 | 1 T | |
| Total # Plies | (3 W × 2 rev) + 7 T = 13 | 6 S + 7 T = 13 |

Excess parts of the containers are removed by cutting after curing the parts. Openings in subcontainer 330C create i) the passageway for inserting the threat item and cap 340 via opening 312, and ii) allow for operation of the door via door slot 338. In an embodiment, the passage opening 312 is cut with subcontainers 330A, 330B, 330C nested to assure proper alignment of the openings through the walls of the subcontainers and smooth insertion of the cap 340.

Figure 6:
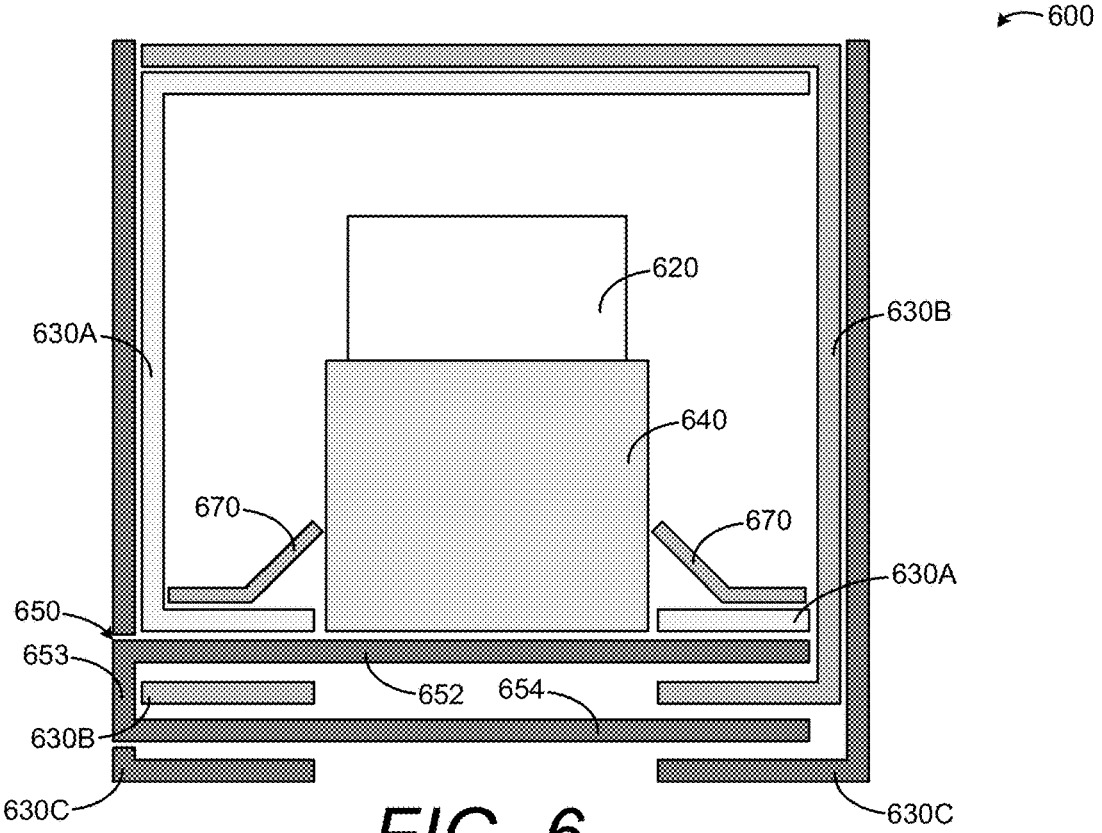
FIG. 6 illustrates a cross-section top view of a device including a plurality of subcontainers and a door according to an example embodiment.

The door 350 has three walls (sides) that form a 'U' shape (see, e.g., FIG. 6 showing top cross-section view of door 650 illustrating all three walls/sides). The three sides are referred as first door panel 652, second door panel 654, and side door panel 653 that connects the first and second door panels 652, 654. An embodiment of the door 350 has goal dimensions (L×W) for inside and outside (first/second) faces/panels of 17.0 inches×9.8 inches, and goal wall thicknesses for the inside and the outside faces (first/second panels) of approximately 0.40 inches and 0.30 inches, respectively. A gap of 0.35 inches is maintained between the first/second panels. This gap will span the front side of the second subcontainer 330B of the assembled TMU device 300. The inside and outside faces (first/second panels) of the door 350 are connected through the side panel, which has a goal wall thickness of 0.25 inches. The material used for fabricating this component is Kevlar 745 prepreg. The prepreg material is cut to layers in two rectangular shapes: Long (L) plies at nominal dimensions of 38 inches×12 inches, and Short (S) plies at 19 inches×12 inches. A total of 13 L and 12 S plies are used to fabricate this item. The L plies are first folded into 'U' shapes. During the folding, a ⅛ inches increment is applied in every two layers. All 13 L plies are stacked onto a mold to form a continuous laminate covering the three sides of the door. The S plies are then inserted into the stacked plies to make up the wall thickness differences among the sides. The cured part is trimmed to final dimensions. Table 6 below summarizes the stacking sequence fabrication.

TABLE 6

| Sequence | Inside Face | Side | Outside Face |
|---|---|---|---|
| 1 (bag side) | 2 S | 3 L | 1 S |
| 2 | 2 S | 3 L | 1 S |
| 3 | 2 S | 3 L | 1 S |
| 4 | 2 S | 3 L | 1 S |
| 5 (mold side) | | 1 L | |
| Total # Plies | 13 L, 8 S | 13 L | 13 L, 4 S |

Two different processing conditions are used to fabricate the various components. In one processing condition, for each component of the cap 340, tube 320 and gasket 370 (UHMWPE), the stacked preform is first bagged and sealed. The sealed part is placed in an autoclave. Heat and pressure are applied concurrently. The part is heated to 260 degrees F. at a ramp rate of 5 degrees F./minute. Pressure is applied incrementally (5 psi/minute) to 225 psi. When the pressure is greater than 50 psi, the bag is vented. Once the thermocouple inside the autoclave indicates a temperature over 250 degrees F., the part is soaked/held at that temperature for two hours. Then the part is cooled down at 5 degrees F./per minute with a temperature set point of 90 degrees F. Once the thermocouple temperate reading is below 95 degrees F., pressure is released. The autoclave run is ended when the pressure is less than 2 psi. The cured part is removed from the Autoclave and debagged.

In another processing condition, for each component of the door 350 and subcontainers 330A, 330B, 330C (Kevlar/Phenolic), the stacked preform is first bagged and sealed. The sealed part is placed in an autoclave. The part is heated to 330 degrees F. at 5 degrees F./minute ramp rate. Once the Hi-thermocouple inside the autoclave reading reaches greater than 230 degrees F., pressure is applied incrementally (5 psi/minute) to 200 psi. When the pressure is greater than 50 psi, the bag is vented. Once the thermocouple inside the autoclave has a temperature reading greater than 315 degrees F., and a pressure reading greater than 150 psi, the part is soaked/held for 75 minutes. Then the part is cooled down at 5 degrees F./per minute with a temperature set point of 140 degrees F. Once the thermocouple temperate reaches 140 degrees F., pressure is released, and the part continues to cool down with a temperature set point of 80 degrees F. When the thermocouple reading indicates a temperature below 120 degrees F., the autoclave run is ended. The cured part is removed from the Autoclave and debagged.

Figure 5:
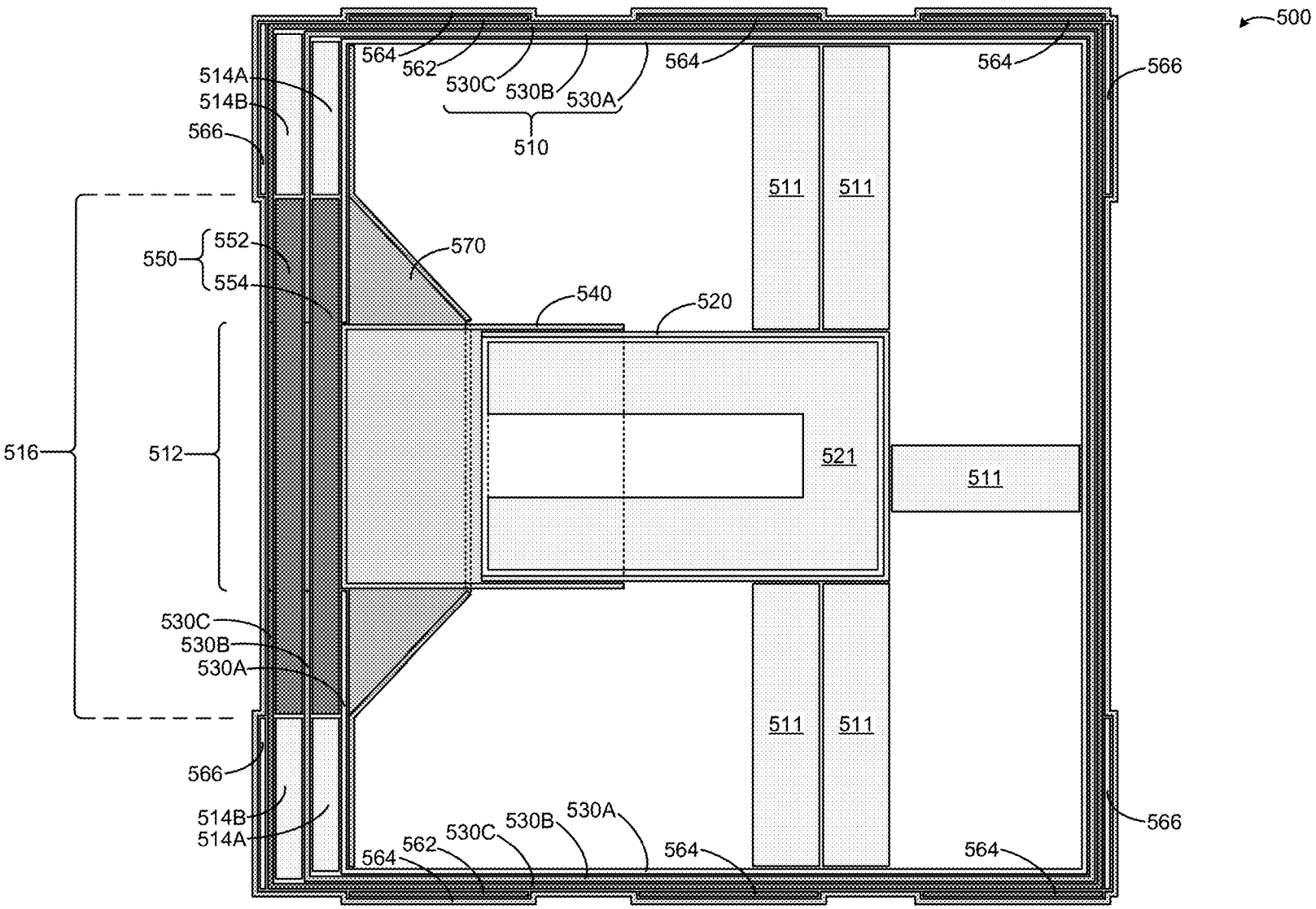
FIG. 5 illustrates a cross-section side view of a device including a plurality of subcontainers and a door according to an example embodiment.

FIG. 5 illustrates a cross-section side view of a device 500 including a plurality of subcontainers 530A, 530B, 530C and a door 550 according to an example embodiment. The subcontainers 530A, 530B, 530C are wrapped in plurality of wraps including SS wraps 562, VFB wraps 564, and HFB wraps 566. Subcontainers 530C and 530B are spaced apart by spacers 514B to accommodate first door panel 552 of the door 550, and subcontainers 530B and 530A are spaced apart by spacers 514A to accommodate second door panel 554 of the door 550. The spacers 514A, 514B also establish a door channel 516 to slidably accommodate the door 550 along the vertical dimension. The subcontainers 530A, 530B, 530C include opening 512 for insertion and removal of the cap 540, allowing the cap 540 to pass through the opening 512 and the gasket 570, to interface with the tube 520. The tube 520 is stabilized within the container 510 via tube stabilizers 511, which are configured to stabilize within the container the tube 520, and maintain spacing between the tube 520 and at least one inner wall of the container 510. The tube 520 includes a removable and configurable item stabilizer 521, to accommodate various different types of items (not shown) to be inserted and stored in the tube 520.

The item stabilizer 521 is shown as a single piece in FIG. 5. In other embodiments, the item stabilizer 521 is formed of multiple sections (e.g., see two-piece example item stabilizer 921 shown in FIG. 9A, with other embodiments formed of more than two pieces). The item stabilizer 521 is configured to stabilize an item to be stored in the tube 520, to establish a suitable orientation and spacing of the item away from at least one wall of the tube 520. The item stabilizer 521 enables optimal positioning of the item relative to the tube 520 and the container 510. Different types of threat items are associated with different types of orientations to maximize threat mitigation, such that the item stabilizer 521 provides yet another mitigation mechanism that enhances the overall performance of the device 500. Simulations of explosive charges positioned at maximum angles relative with the tube 520 indicated that non-optimal loading of the TMU can occur at extreme angles of orientation of the threat item. Accordingly, the item stabilizer 521 enables the threat items to achieve parallel orientations, or other orientations, that avoid extreme angles. Accordingly, embodiments of the device 500 include multiple different customized item stabilizers 521, allowing sections of the item stabilizers 521 to be selectively removed as needed to achieve adjustment capabilities. In an example embodiment, the item stabilizer 521 is formed as a plurality of foam inserts, positioned in the tube 520 to isolate the threat item away from the tube 520 and stabilize its orientation/position in the tube 520. Accordingly, the device 500 prevents threat items from producing an angled charge that would cause a biased loading within the TMU device 500, thereby avoiding the potential for gas leakage through the surface interfaces of components of the device 500, and potential failure of blast containment.

FIG. 6 illustrates a cross-section top view of a device 600 including a plurality of subcontainers 630A, 630B, 630C and a door 650 according to an example embodiment. The door 650 is inserted through a door slot of the third subcontainer 630C, to enclose the cap 640 interfaced with and covering an end of the tube 620. The various spacing and thicknesses of the components are not shown to scale.

The device 600 includes various features and mechanisms to improve gas pressure containment. For example, gasket 670 is secured to an interior wall around the opening of the first subcontainer 630A to seal against outer sides of the cap 640. Additionally, an open side of each of the three subcontainers is closed off by two closed walls from other subcontainers. The illustrated embodiment is formed of three subcontainers, and in other embodiments formed of n total subcontainers, a similar approach can be used to arrange the n subcontainers such that an open wall of a given subcontainer faces toward (n−1) closed walls of the other (n−1) subcontainers.

The door 650 includes first door panel 652, side door panel 653, and second door panel 654. The first and second door panels 652, 654 are spaced apart to sandwich a sub-opening wall of the second nested subcontainer 630B. Accordingly, the dimensions of the side door panel 653 enable the first and second door panels 652, 654 to accommodate and slide around the wall thickness of the second subcontainer 630B. Door panel thicknesses correspond to subcontainer spacer thicknesses, such that the first door panel 652 is configured to slide in a first spacing between first and second nested subcontainers 630A, 630B, and the second door panel 654 is configured to slide in a second spacing between second and third nested subcontainers 630B, 630C.

Figure 7:
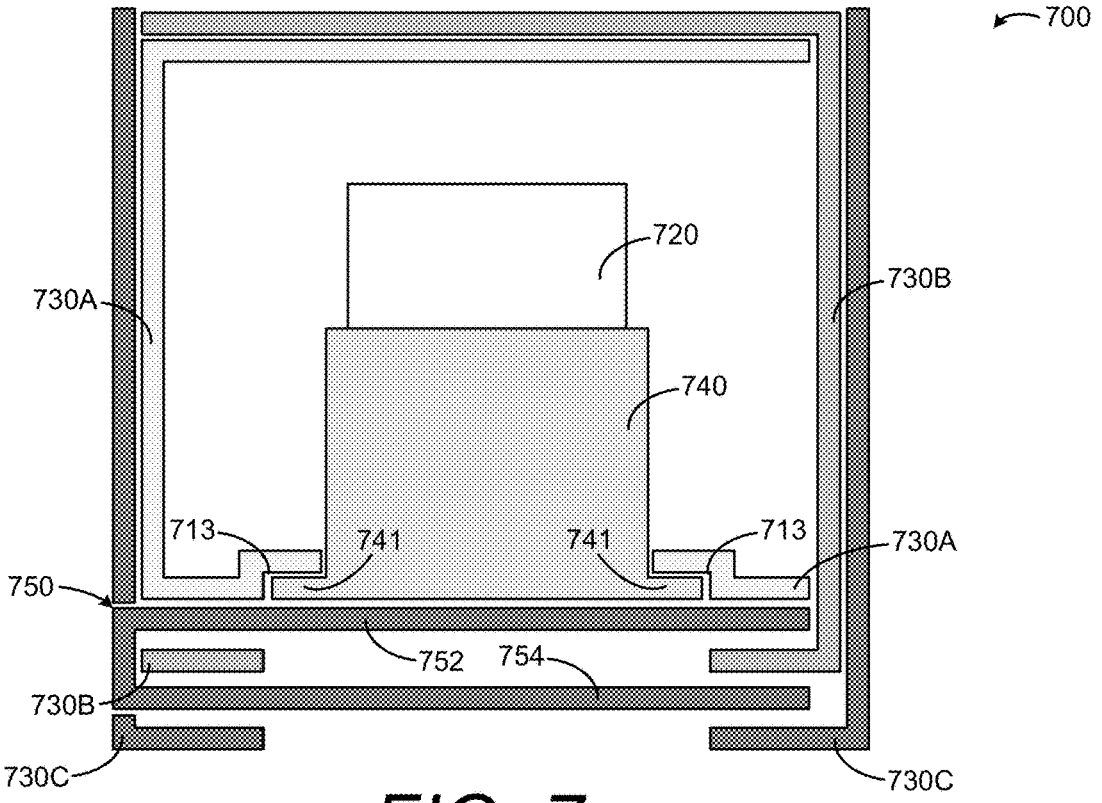
FIG. 7 illustrates a cross-section top view of a device including a plurality of subcontainers and a door according to an example embodiment.

FIG. 7 illustrates a cross-section top view of a device 700 including a plurality of subcontainers 730A, 730B, 730C and a door 750 according to an example embodiment. Similar to the embodiment of device 600 shown in FIG. 6, the embodiment of device 700 in FIG. 7 accommodates the panels 752, 754 of the door 750 between and around the various subcontainers 730A, 730B, 730C. The gasket 670 of FIG. 6 is not specifically shown in the example embodiment shown in FIG. 7. However, in other embodiments, the device 700 also is fitted with a gasket, such as gasket 670.

The cap 740 is shown fitted over an end of the tube 720. The cap 740 includes a flange 741, disposed on an end of the cap 740. The flange 741 extends outward from the cap 740 to seal with the container via subcontainer 730A. Accordingly, the flange 741 provides gas leakage mitigation via yet another mechanism, in addition to the gasket mechanism illustrated in FIG. 6. Furthermore, the flange 741 is secured mechanically between the subcontainer 730A and the door 750, thereby preventing the cap pulling away (e.g., inward) from the door area. Accordingly, the embodiment of FIG. 7 enhances sealing of the cap 740, the inner subcontainer 730A, and the door 750. The embodiment of FIG. 7 also includes a variation in the features of the inner subcontainer 730A that interface with the cap flange 741. For example, the inner container front wall (facing the door) includes a concavity 713, to accommodate the flange 741 and create an interlock between the cap 740 and the subcontainer 730A. the flange 741 and concavity 713 features do not interfere with the fitment of a gasket, which is compatible with the embodiment shown in FIG. 7 and can be used if such additional mitigation mechanism is desired in the illustrated embodiment of FIG. 7.

Figure 8:
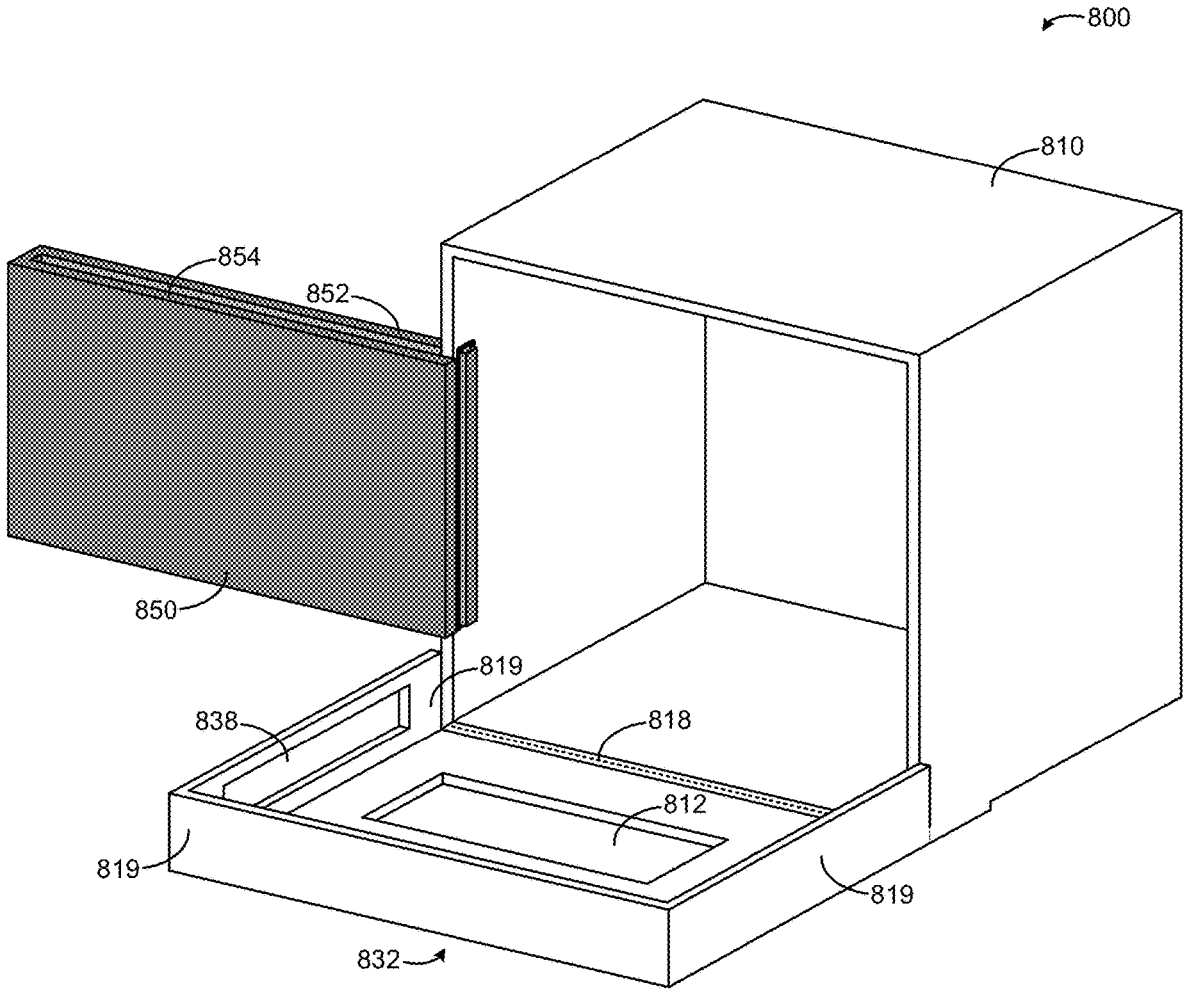
FIG. 8 illustrates a perspective view of a device including a foldable region and a door according to an example embodiment.

FIG. 8 illustrates a perspective view of a device 800 including one or more foldable region(s) 818 and a door 850 according to an example embodiment. The container 810 is constructed with the sub-opening wall 832 already in place, via the foldable region 818. The sub-opening wall 832 includes already-formed opening 812, and a plurality of overhangs 819 (one of which includes door slot 838).

The illustrated embodiment is advanced through the use of three-dimensional (3-D) weaving/printing technology, which avoids a need for individual components to be fabricated via a 2-D laminate method where fiber layers are stacked and adhered together with polymer adhesives, and avoids risk of failure via delamination, thus increasing structural rigidity of the system during high rate loading. The container 810 is formed as a one-piece three-dimensional structure integrally woven with continuous fibers, including the foldable region 818 connecting the front, sub-opening wall 832 to the container 810. The front sub-opening wall 832 operates as a door flap, and includes overhangs 819. The overhangs 819 are stitchable and bondable, such that when the door flap is folded upward to enclose the container 810, the overhangs 819 are positioned to be stitched or otherwise bonded to/integrated with a top wall and side walls of the container 810.

Compared to embodiments based on 2-D laminates, the 3-D woven structures in the embodiment of FIG. 8 exhibit improved delamination resistance, as well as higher energy absorption, providing additional mitigation mechanisms. The 3-D weaving reduces constraints on the design of the TMU device 800. For example, device 800 avoids a need to fabricate by stacking disjoint fiber layers per side, which are then supported by fiber wrap layers, thereby creating corners that experience stress concentration. The performance of the example TMU device 800 benefits from the 3-D woven system design, where all sides (as well as openings) of a given component are interwoven with continuous fibers, eliminating the disjointed areas associated with use of individual fiber layers and fiber cut outs. Fiber cut outs introduce discontinuous fibers in the construction, so the device 800 avoids disruptions of load-carrying continuity and avoids decreased load carrying capacity associated with cut outs.

The woven embodiment of device 800 provides multiple components as a single unified piece thereby reducing overall number of separate components, and weaves different parts together for strength. Accordingly, the embodiment of TMU device 800 based on 3-D woven structure enables a 30-40% weight savings, compared to a similar structure based on 2-D laminate designs of similar mitigation strength.

The 3-D woven embodiment of TMU device 800 shown in FIG. 8 includes two separate components, a detached sliding door 850, and the container 810. In other embodiments, the 3-D weaving/printing technology is used to manufacture both of these components as a single component, by including a flexible printed tether attaching the door 850 to the container 810, while allowing the door 850 to be operated. The container 810 is woven as a single unified piece including one or more folding regions 818, that allow the front face (sub-opening wall 832 including opening 812 for insertion of the cap) to be folded up and back against the 5-sided section of the container 810. Once folded, the front face is stitched to other sections (sides and top of the container 810). Furthermore, overwraps are applied, as appropriate for a given level of desired mitigation performance (e.g., for storing larger items capable of generating more blast pressure, one or more wraps are added as shown in FIGS. 3F-3H, and for smaller items, the wraps can be omitted). In other embodiments, the dimensions of the overhangs 819 are varied to provide additional mitigation strength and resistance against blast leakage or other forces. After wraps are applied as needed, the device 800 is processed through infiltration and curing.

Thus, the embodiment of device 800 does not need three disjoint subcontainers, and instead relies on a single cubic container where all six sides are integrally woven with continuous fibers. A collapsible mold design is used for molding the 3-D woven TMU device 800. Embodiments are provided with alternate container shapes, such as those based on 3-D woven cylindrical or spherical containers to avoid the weak points of the corners/edges. Additionally, embodiments use combinations of shapes, such as the use of a cylindrically shaped or spherically shaped cap/tube within the container 810, while a different shape is used for the container 810, such as the illustrated cube shape, outside the cap/tube. The door 850 is shown as a flat rectangular shape suitable for the cube-shaped container 810. However, various other shapes are used in other embodiments, such as door shapes that are suitable to fit the topology of the outer container (e.g., using a curved door to fit a cylindrical or spherical outer container 810). The various movable components, such as the door (and an insertable cap, not shown in FIG. 8), are securable to the box via tethers, and the 3-D printing approach enables the tethers to be printed in place along with the components.

Figure 9B:
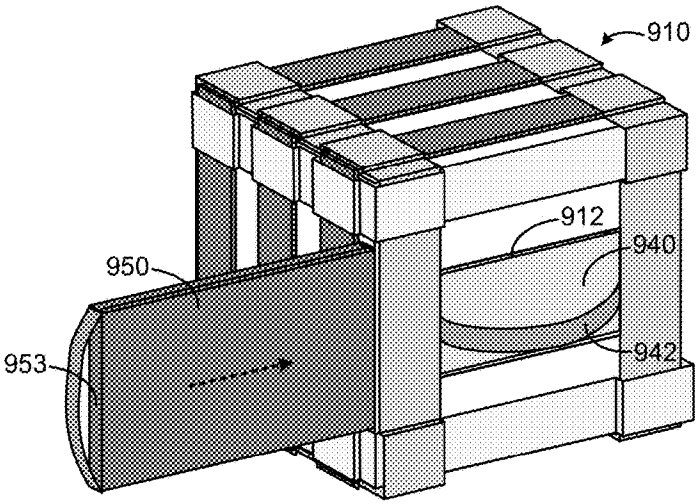
FIGS. 9A, 9B, and 9C illustrate perspective views of a device configured to store an item according to an example embodiment.
Figure 9A:
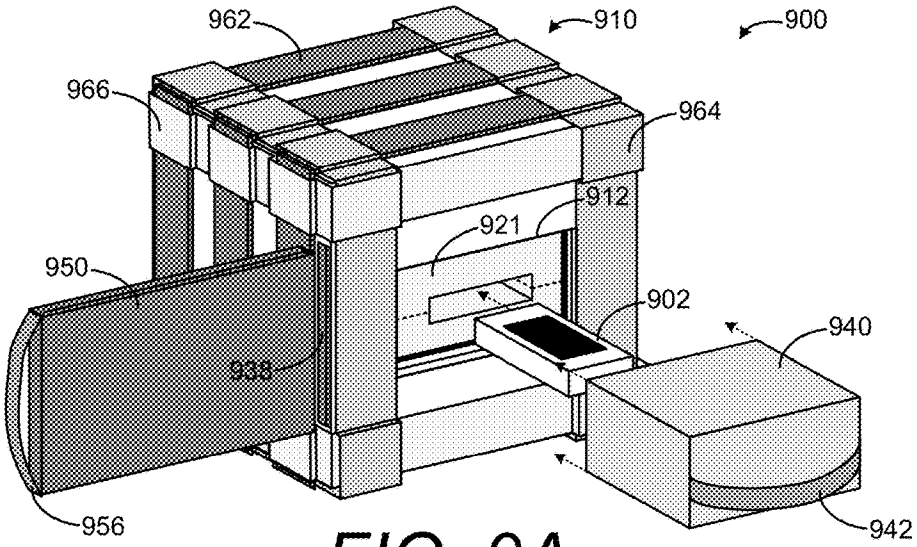
Figure 9C:
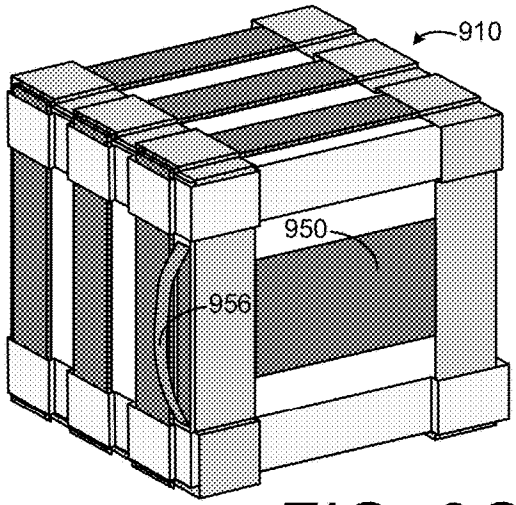

FIGS. 9A-9C illustrate perspective views of a device 900 configured to store an item 902 according to an example embodiment. The device 900 is in a deployed state, and the illustrated embodiment is shown with fully removable door 950, cap 940, and item stabilizer 921. In other embodiments, any or all of these fully removable components include tethers, coupling the removable components to the container 910.

Embodiments of device 900 are compatible with storing the device 900 in an external case, such as a Pelican case with wheels and handle, for easy transporting and storage of the device 900. In a stored state inside the external case, the door 950 and the cap 940 are stored inserted into the device 900. The external case lid is unlatched and opened, enabling the TMU device 900 to be accessible while still stored in the external case. In an example, the device 900 is stored in the external case with the opening 912 facing upward out of the external case, in the same orientation as the opening of the external case. As illustrated in FIG. 9A, the opening 912 is shown oriented to face sideways.

FIG. 9A illustrates the door 950 and cap 940 removed from the container 910, opening the device 900 ready for placement of the item 902 into the item stabilizer 921 through the opening 912. The TMU door 950 is opened by pulling the door handle 956 outward. The door 950 is shown fully removed from the TMU. However, the door 950 is capable of remaining partially engaged with the TMU, slid to the side to sufficiently allow access to the opening 912 and to allow removal of the cap 940. In other embodiments, the door 950 includes a tether, to secure the door 950 to the TMU and/or external case, to prevent misplacing/loss of the door 950. In other embodiments, the door tether is configured to limit the range of opening the door 950, to prevent the door from being fully removed from its door slot 938.

After opening the door 950, the cap 940 is removed, e.g., by gripping the cap handle 942 near both ends and evenly pulling on the two ends of the cap handle 942 to remove the cap 940. The item 902 is inserted into the opening 912 of the device 900. As illustrated, the opening 912 includes item stabilizers 921, provided as foam inserts that create a foam slot located inside the tube of the device 900. The item stabilizers 921 are independently removable, to allow removal of one or both item stabilizers 921 to increase space and allow for insertion of larger items into the TMU tube (e.g., with one or no item stabilizers 921, or smaller item stabilizer(s) 921 not shown). Different sizes and densities of item stabilizers 921 are available, to accommodate different sized items 902. In other embodiments, an item stabilizer 921 includes a strap and/or tether (not shown), to facilitate removal of the item stabilizer 921 from the container 910, and/or to prevent misplacement of the item stabilizer 921. The item 902 is insertable into the TMU device 900 with or without the item stabilizers 921, as appropriate for the size and dimensions of the threat item 902, and/or a desired orientation for that given threat item 902 within the container 910. Item stabilizers 921 are usable to securely hold the item 902 in a given orientation (e.g., vertical or horizontal depending on whether the TMU device 900 is placed facing sideways or upward), and are usable to prevent the item 902 from tilting or otherwise assuming a non-optimal angle as determined for the characteristics of that threat item.

The cap 940 is inserted into the TMU device 900. In an embodiment, the cap 940 includes an alignment arrow to be aligned with a corresponding alignment arrow on the device 900. The cap 940 is grippable on both ends using two hands, for smooth even insertion into the tube of the TMU device 900. The cap 940 is pushed evenly into the TMU device 900 until the outwardly exposed face of the cap 940 is level with an interior cavity face of the TMU device 900, e.g., to clear the door 950 when the door 950 is closed.

FIG. 9B illustrates placement of the cap 940 and the beginning of closing of the door 950. With the cap 940 closed in place, the door 950 is closed by sliding the door 950 into the door slot 938 of the TMU device 900, until an alignment mark on the door 950 (not shown in the illustrated embodiment) aligns with an alignment mark on the TMU device 900 (also not shown). For example, closure of the door 950 is observable when a side panel 953 of the door 950 is flush with an outer surface of the TMU container 910 at the door slot 938.

FIG. 9C illustrates the container 910 with door 950 closed, and door side panel 953 flush with an outer surface of the TMU container 910. In embodiments using an external case, with the door 950 closed, the lid of the Pelican case is closed and latched securely.

The various embodiments of the illustrated TMU devices met the goals for containment of a predetermined threat volume and explosive mass. In other embodiments, various dimensions and capabilities of the TMU device are extended or reduced, to receive threat items of larger or smaller physical sizes, and/or of different explosive masses. Suitable variants of other dimensions of the example embodiments are determined based on the various detailed approaches set forth above regarding iterative simulation and experimentation. Such procedures are readily usable to expedite development of other embodiments not specifically illustrated.

What is claimed is:

1. A device comprising:

a container including an opening;

a tube disposed in the container and aligned with the opening;

a cap configured to slidably interface with the tube through the opening to form an interior closed compartment; and a door configured to slidably close the opening to enclose the cap within the container; the container including a plurality of subcontainers surrounding the interior closed compartment.

2. The device of claim 1, wherein n subcontainers of the plurality of subcontainers are nested to orient an open side of a given subcontainer toward n-1 closed walls of n-1 corresponding other subcontainers.

3. The device of claim 1, further comprising a plurality of spacers disposed between adjacent subcontainers to establish a channel within which the door is slidable.

4. The device of claim 1, wherein:

the plurality of subcontainers are nested as a first subcontainer within a second subcontainer within a third subcontainer;

the first subcontainer includes a first sub-opening wall that surrounds a portion of the opening of the container, the second subcontainer includes a second sub-opening wall that surrounds a portion of the opening of the container, and the third subcontainer includes a third sub-opening wall that surrounds a portion of the opening of the container;

the door includes a first door panel and a second door panel; and the device further comprises a first spacing between the first sub-opening wall and the second sub-opening wall, and a second spacing between the second sub-opening wall and the third sub-opening wall, wherein the first spacing is configured to accommodate the first door panel, and the second spacing is configured to accommodate the second door panel.

5. The device of claim 1, wherein a subcontainer comprises a plurality of differently shaped sheets layered together, wherein a first seam of a first sheet does not align with a second seam of a second sheet.

6. The device of claim 1, wherein the container includes a plurality of wraps disposed around the container.

7. The device of claim 6, wherein the plurality of wraps comprises a plurality of side-to-side wraps aligned along a first plane, a plurality of vertical front-to-back wraps aligned along a second plane perpendicular to the first plane, and a plurality of horizontal front-to-back wraps aligned along a third plane perpendicular to the first and second planes.

8. The device of claim 6, wherein at least a portion of the plurality of wraps are intertwined over and under.

9. The device of claim 1, further comprising a gasket disposed around the opening and extending between the container and the cap that is interfaced with the tube.

10. The device of claim 1, wherein:

the container is a one-piece, three-dimensional structure;

the container is formed from integrally woven, continuous fibers;

the container further comprises a foldable region;

the foldable region connects a front wall to the container;

the front wall comprises a door flap;

the door flap comprises overhangs; and the overhangs of the door flap are stitched to a top wall of the container and side walls of the container to enclose the container.

11. The device of claim 1, further comprising a tube stabilizer disposed in the container and configured to stabilize within the container the tube spaced by the tube stabilizer from at least one wall of the container.

12. The device of claim 1, further comprising an item stabilizer disposed in the tube and configured to stabilize within the tube an item spaced by the item stabilizer from at least one wall of the tube.

13. The device of claim 1, wherein the tube and the cap each comprise a plurality of differently shaped sheets layered together, wherein a first seam of a first sheet does not align with a second seam of a second sheet.

14. The device of claim 1, wherein the cap includes a flange disposed on an end of the cap, configured to extend outward from the cap to seal with the container.

15. The device of claim 14, wherein the container includes a concavity around the door opening to accommodate the flange of the cap between the concavity and the door.

16. The device of claim 1, wherein the door has a U-configuration including a first door panel, a second door panel spaced from the first door panel, and a side door panel connecting the first door panel to the second door panel.

17. The device of claim 16, wherein the first door panel and the second door panel are spaced apart to sandwich a second sub-opening wall of a second nested subcontainer of the container, wherein the first door panel is configured to slide in a first spacing between a first subcontainer nested within a second subcontainer, and wherein the second door panel is configured to slide in a second spacing between the second subcontainer nested within a third subcontainer.

18. A device comprising:

a container comprising a plurality of subcontainers and an opening;

a tube disposed in the container and aligned with the opening;

a plurality of wraps disposed around the container;

a cap configured to slidably interface with the tube through the opening and through at least a portion of the plurality of wraps; and a door configured to slidably close the opening to enclose the cap within the container.

19. A device comprising:

a container comprising a plurality of subcontainers and an opening;

a tube disposed in the container and aligned with the opening;

a cap configured to slidably interface with the tube through the opening; and a door configured to slidably close the opening to enclose the cap within the container, based on being slidable between at least two subcontainers.

* * * * *